US007210508B2

(12) United States Patent
Behar

(10) Patent No.: US 7,210,508 B2
(45) Date of Patent: May 1, 2007

(54) REFILL FOR COSMETIC PRODUCT DISPENSER

(75) Inventor: Alain Behar, Suresnes (FR)

(73) Assignee: MT Packaging, Plouhinec (FR)

( * ) Notice: Subject to any disclaimer, the term of this patent is extended or adjusted under 35 U.S.C. 154(b) by 167 days.

(21) Appl. No.: 11/076,019

(22) Filed: Mar. 10, 2005

(65) Prior Publication Data

US 2005/0205151 A1 Sep. 22, 2005

(30) Foreign Application Priority Data

Mar. 19, 2004 (FR) ..... 04 02853

(51) Int. Cl.
*B65B 1/04* (2006.01)

(52) U.S. Cl. ..... 141/329; 141/319; 141/363; 141/364; 141/365; 141/366

(58) Field of Classification Search ..... 141/2, 141/18, 319, 329, 330, 363–366; 206/222
See application file for complete search history.

(56) References Cited

U.S. PATENT DOCUMENTS

| | | | | |
|---|---|---|---|---|
| 4,244,467 | A | 1/1981 | Cavazza | |
| 4,346,820 | A * | 8/1982 | Cavazza | 222/83 |
| 5,186,323 | A * | 2/1993 | Pfleger | 206/221 |
| 5,287,898 | A * | 2/1994 | Falb et al. | 141/329 |
| 5,505,235 | A * | 4/1996 | Gorokhovsky et al. | 141/319 |
| 5,782,345 | A | 7/1998 | Guasch et al. | |
| 6,237,649 | B1 | 5/2001 | Moisio et al. | |
| 2002/0020637 | A1 | 2/2002 | De Laforcade | |
| 2002/0066677 | A1 | 6/2002 | Moscovitz | |

FOREIGN PATENT DOCUMENTS

| | | |
|---|---|---|
| FR | 2638721 | 5/1990 |
| GB | 2279069 | 12/1994 |

* cited by examiner

*Primary Examiner*—Timothy L. Maust
(74) *Attorney, Agent, or Firm*—Dennison, Schultz & MacDonald

(57) ABSTRACT

A refill device for a receptacle provided with a threaded neck including a receptacle, designed to contain a product to be transferred into the receptacle, a cooperation structure designed to form a connection between the first and a second receptacle, a closing structure for closing off the receptacle, a transferring structure for transferring the product contained in the receptacle to the receptacle. The cooperation structure includes a threaded base capable of cooperating with the neck, the closing structure comprises a wall closing off the base, designed to be broken off by an axial force, the transfer structure includes an axial packing designed to be placed above the wall, such that during the said screwing of the neck, the neck pushes the axial packing into contact with the wall, so as to break the wall and enable the liquid to flow by gravity.

22 Claims, 7 Drawing Sheets

FIG. 3b
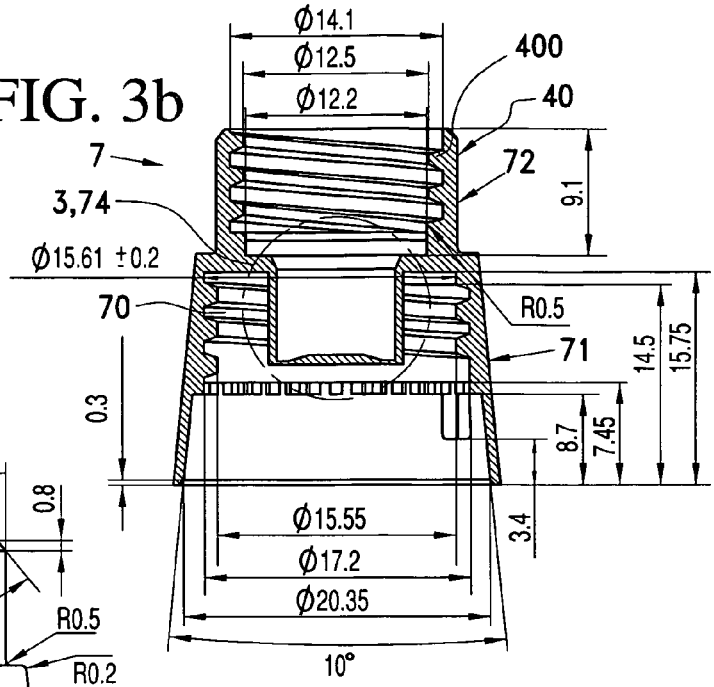
FIG. 3a
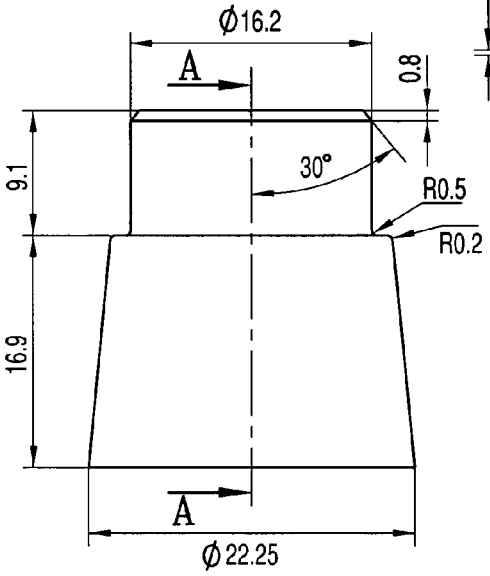
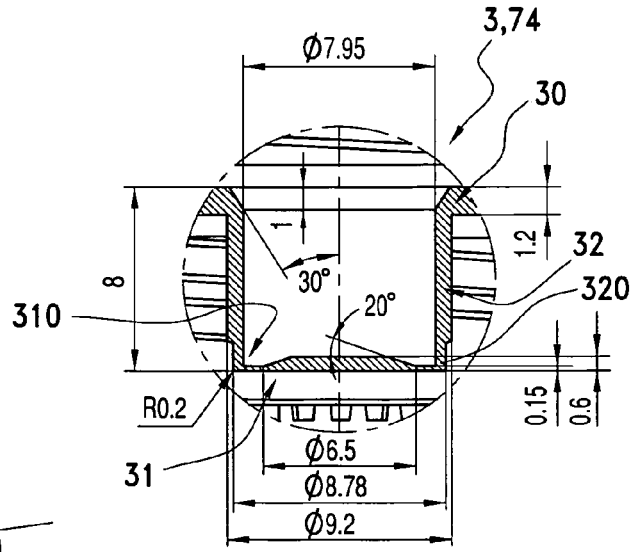
FIG. 3d
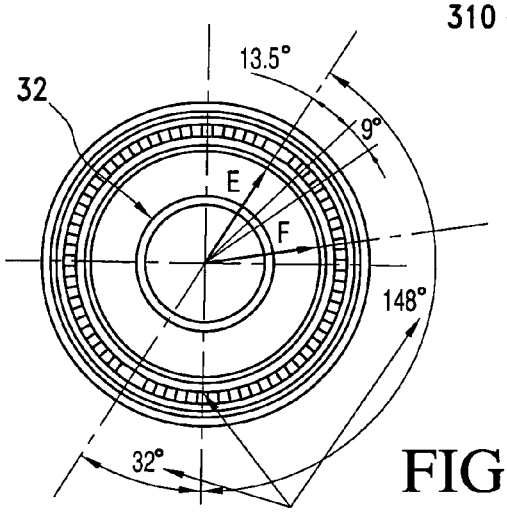
FIG. 3c

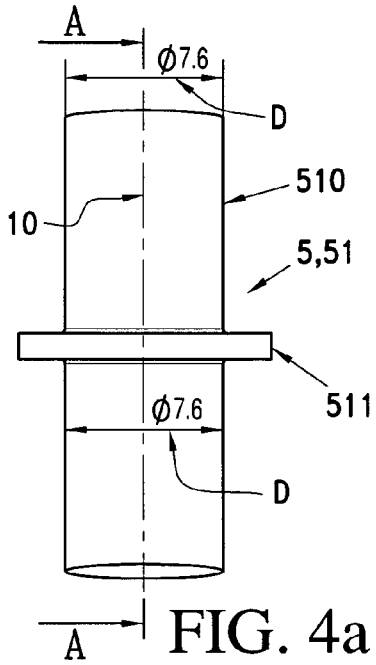
FIG. 4a
FIG. 4b
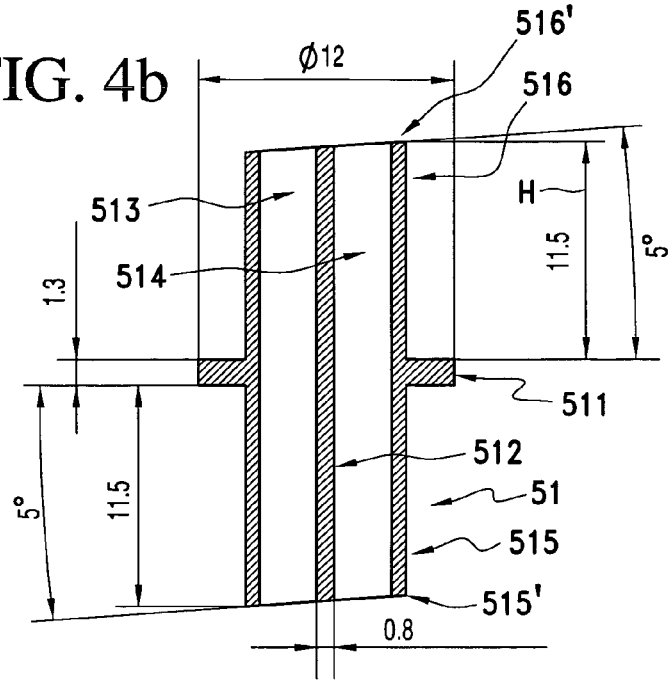
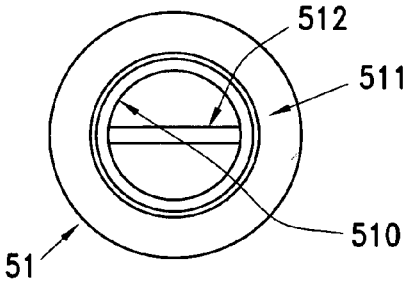
FIG. 4c
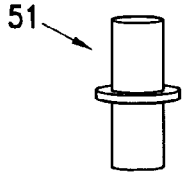
FIG. 4d
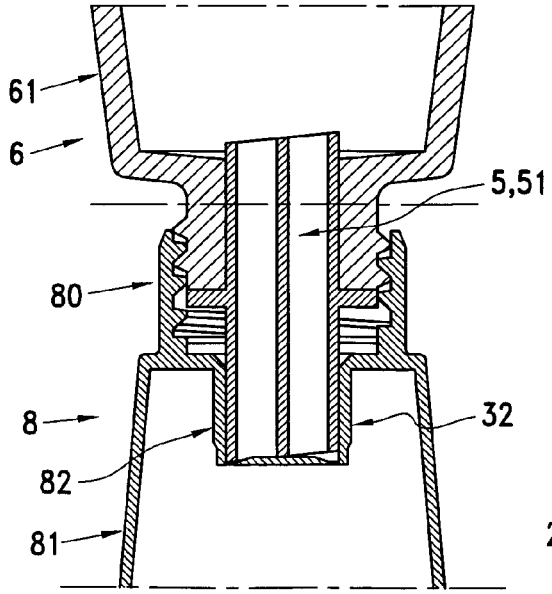
FIG. 4e
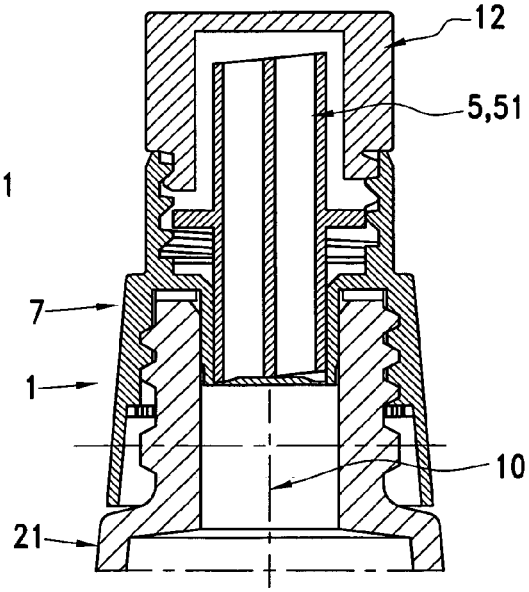
FIG. 4f FIG. 5c
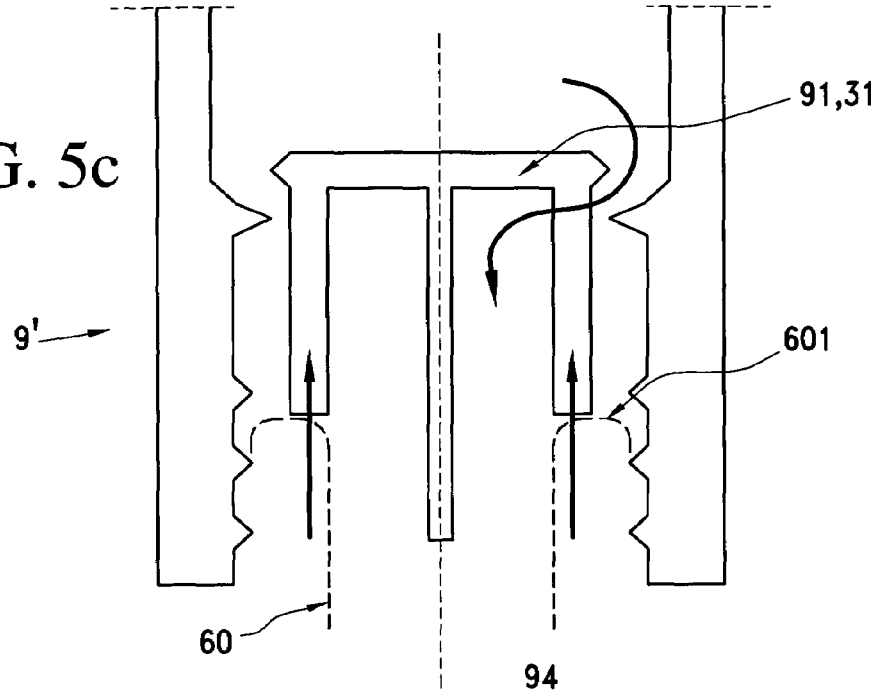
FIG. 5b
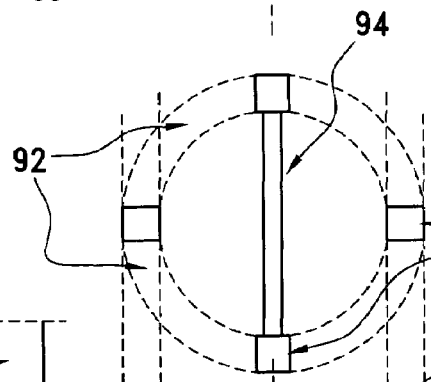
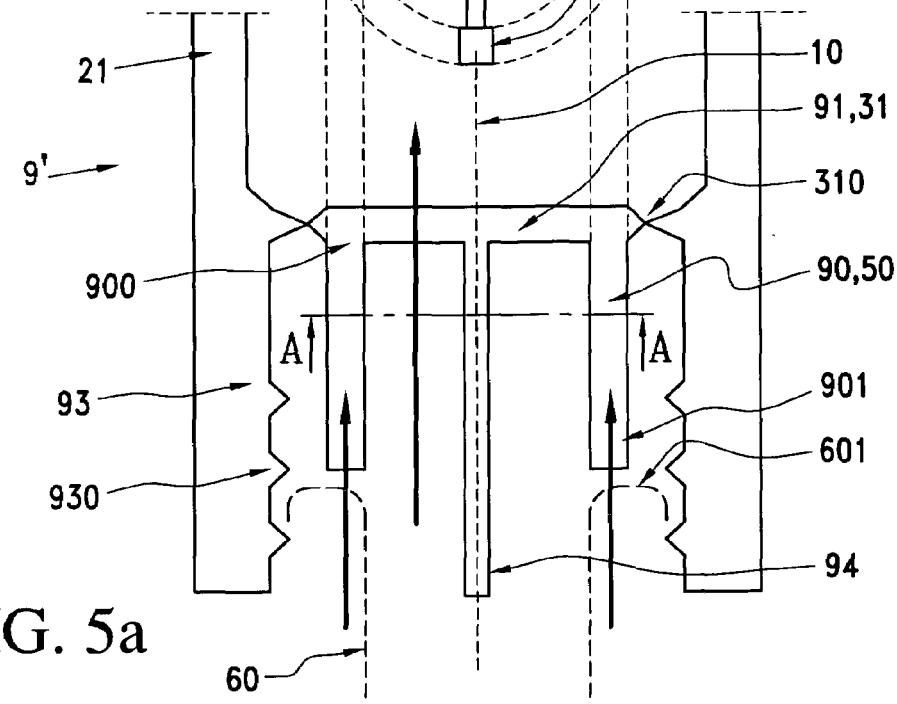
FIG. 5a FIG. 7b
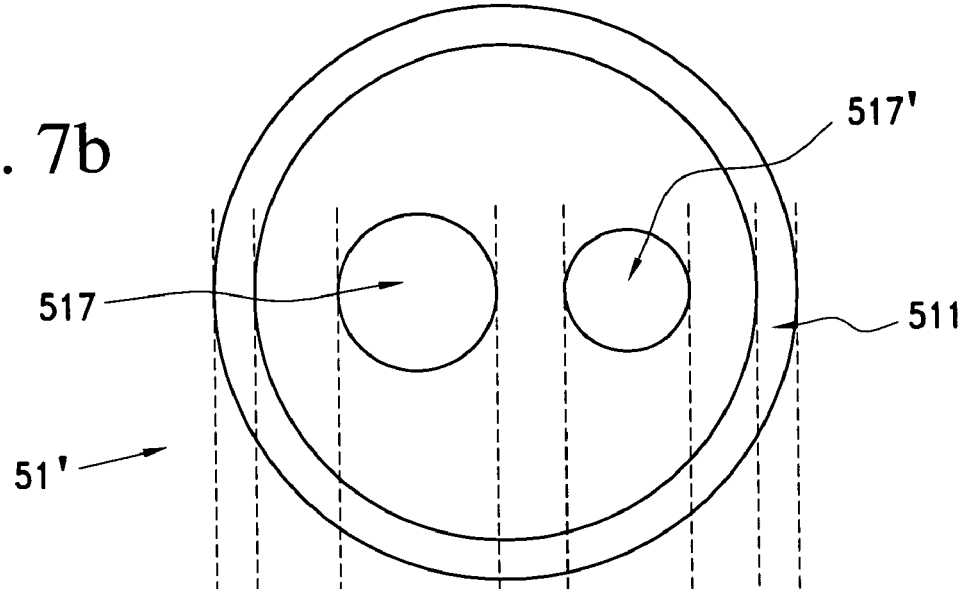
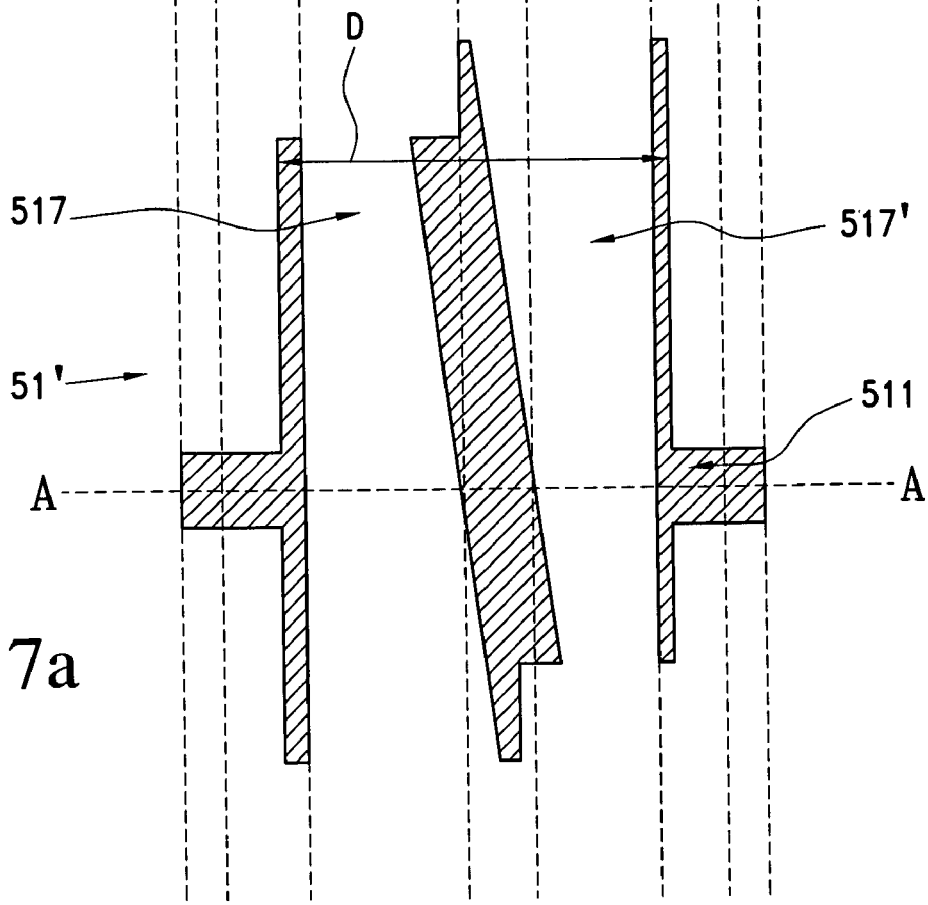
FIG. 7a

REFILL FOR COSMETIC PRODUCT DISPENSER

FIELD OF THE INVENTION

The invention relates to the domain of cosmetic product dispensers, and particularly the domain of perfume dispensers. The invention relates particularly to the domain of refillable dispensers.

DESCRIPTION OF RELATED ART

Refills for perfume flasks are typically composed of receptacles or flasks comprising a threaded neck closed off by a threaded cap.

Similarly, refillable dispensers typically comprise an atomization head fixed by screwing to a flask comprising a threaded neck.

The normal way of refilling the dispenser is to unscrew the atomization head and manually transfer the refill contents after having unscrewed its cap.

Use of a refill is justified if the dispenser with head is not a discardable object, considering its quality and its price.

However, the value of a refill for the refillable dispenser depends more on the value of its contents than on the value of the receptacle containing the refill, such that the dispenser refill is typically thrown away or recycled when it is empty, because it has a low intrinsic value.

This normal procedure does cause some problems. Considering that the neck of the said refillable dispenser is typically small, a certain amount of skill or manual dexterity is necessary to transfer the perfume from a refill flask or a feeder to the flask of the said dispenser.

The normal consequences of a transfer, unless the user is very dexterous, are firstly loss of product contained in the refill, which is frequently an expensive perfume, and secondly the risk of getting the clothes and hands dirty with the associated risk of creating a strong and lasting smell associated with such an operation, since the product or the perfume could have spread and impregnated fabric.

French application No. 00 11082 describes a system for filling a secondary flask, starting from a main flask. This type of system is complex in manufacturing and during use. Therefore, the applicant searched for an economic and practical means, in other words easy to use by any person, of avoiding the disadvantages related to the normal manner of proceeding.

SUMMARY OF THE INVENTION

According to the invention, the refill device for a said first receptacle, typically a perfume flask, and typically provided with a first threaded neck and an atomization head, comprises:

a) a receptacle, called the second receptacle, designed to contain a typically liquid product to be transferred into the said first receptacle, typically perfume, b) a means of cooperation designed to form a typically sealed connection between the said first and second receptacles, c) a means of closing off the said second receptacle, d) a means of transferring the said product contained in the said second receptacle to the said first receptacle.

In this device:

1) the said cooperation means includes a typically threaded base, the said first neck and the said base being capable of cooperating by a so-called main screwing, the said first neck typically comprising an external thread and the said base comprising an internal thread, so as to assure total or partial transfer of the said product contained in the said second receptacle, into the said first receptacle, 2) the said closing means comprises a wall closing off the said base, at least one portion of the said wall being designed to be broken off by an axial force, 3) the said transfer means comprises an axial packing placed or designed to be placed above the said portion of the wall, such that during the said main screwing, the said first neck and typically its locking ring, moves or pushes the said axial packing into contact with the said wall portion, such that the said axial packing, applying the said axial force on the said portion of the wall through its lower part, breaks or perforates the said wall portion, and such that the said first and second receptacles put into communication and cooperating through the said main screwing, enable the said transfer, typically by gravity, of the fluid product contained in the said second receptacle to the said first receptacle, the said second receptacle being placed above the said first receptacle.

This combination of means solves the problems that arise.

The transfer of the product is limited to two elementary operations:

firstly, unscrewing of the atomization head in order to open up the said first neck of the said first receptacle, the said first receptacle corresponding to the dispenser to be refilled, secondly, simple screwing of the said device for refilling the said first neck.

Provided that the user is capable of performing these two simple operations, the result to be obtained, namely a clean transfer with no losses, is then automatically achieved.

BRIEF DESCRIPTION OF THE DRAWINGS

All figures relate to the invention.

FIGS. 1*a* to 4*f* relate to the same embodiment of the refill device (1).

FIG. 1*a* shows a side view of a refill device (1) assembled to the said first receptacle (6) to be refilled.

FIG. 2*a* corresponds to a first stage of the said main screwing.

FIG. 2*b* is similar to FIG. 2*a* but corresponds to the last stage of the said main screwing.

FIGS. 3*a* to 3*d* relate to the said first part (7) of FIGS. 2*a* to 2*e*.

FIG. 3*a* shows a side view.

FIG. 3*b* shows an axial section along plane A—A in FIG. 3*a*.

FIG. 3*c* is a bottom view.

FIG. 3*d* shows an enlarged view of the part circled with dashed lines in FIG. 3*b*, related to the central part (74) forming the closing means (3).

FIGS. 4*a* to 4*d* relate to the striker (51) as the transfer means (5).

FIG. 4*a* is a side view.

FIG. 4*b* is an axial section along plane A—A in FIG. 4*a*.

FIG. 4*c* is a top view.

FIG. 4*d* is a perspective side view of the striker (51), at full scale.

FIG. 4*e* is a Figure corresponding to FIG. 2*a* and corresponding to another embodiment of the invention in which the said refill device (1) forms a single-piece part (8).

FIG. 4*f* corresponds to FIG. 2*a*, and shows a refill device (1) including a cap (12) screwed in the same way as the said main screwing, so that during storage or transport of the said refill device (1), it prevents an unwanted axial force from being applied on the said striker (51), and also fixes the said striker (51) to the said refill device (1).

FIG. 5*a* to 6*c* relate to other embodiments of the invention. In these Figures, the said refill device (1) has been shown above the said first receptacle (6) to be filled.

FIG. 5*a* shows a partial axial section of a single-piece dispenser (9') before breakage of the said wall portion (31).

FIG. 5*b* is a cross section perpendicular to the said axial direction (10) in plane A—A in FIG. 5*a*.

FIG. 5*c* corresponds to FIG. 5*a*, and represents the dispenser (9') in FIG. 5*a* after complete screwing of the said first neck (60) and breakage of the said wall portion (31).

FIGS. 6*a* to 6*c* illustrate an embodiment of the refill device (1) in which the said closing means (3), the said cooperation means (4) and the said transfer means (5) form a single-piece head (9).

FIG. 6*a* corresponds to FIG. 5*a*.

FIG. 6*b* shows a cross section perpendicular to the said axial direction (10) along plane A—A in FIG. 6*a*.

FIG. 6*c* is a variant of FIG. 6*a*.

FIGS. 7*a* and 7*b* relate to a striker (51') comprising two inverted tapered pipes (517, 517'), offset in the axial direction and typically with a different average section.

FIG. 7*a* is an axial section.

FIG. 7*b* is a cross section along plane A—A in FIG. 7*a*.

DESCRIPTION OF THE PREFERRED EMBODIMENTS

Figure 1A:
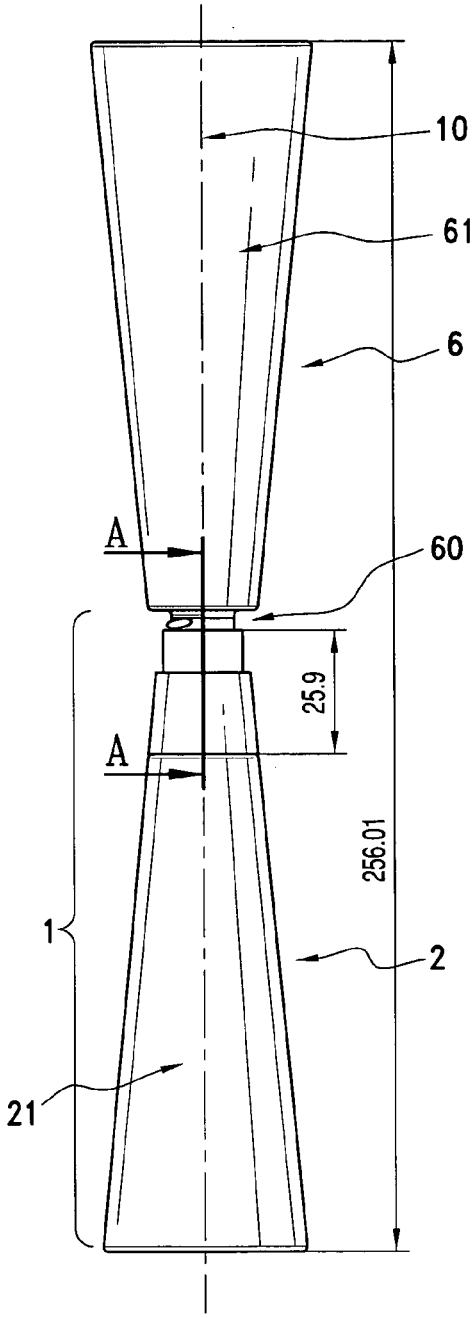

According to a first embodiment of the invention, as illustrated in FIGS. 1*a* to 3*d*, the said closing means (3) can form a said first part (7) with the said base (40), typically a moulded part separate from the said second receptacle (2), capable of being fixed to the said second receptacle, typically by a so-called secondary screwing using a so-called secondary thread (70), the said first part (7) comprising a lower skirt (71) carrying the said secondary thread (70) on its inside surface that can cooperate by screwing with a threaded neck (20) of the said second receptacle (2), a seal (11) typically being used to make a leak tight closure of the said second receptacle (2) by the said first part (7), the said lower skirt (71) typically comprising at least one anti-rotation notch (73) to block the said secondary screwing.

According to another embodiment of the invention, as illustrated in FIG. 4*e*, the said second receptacle (2) and the said base (40) provided with the said closing means (3) may form a typically moulded single-piece part or body (8).

In this case, the said receptacle (2) is opened, typically at the bottom, so that it can be filled.

Regardless of the embodiment of the invention, and for example as illustrated in FIG. 3*d*, the said wall portion (31) may include a peripheral area (310) that is completely or partly thinned, so as to form an area of weakness facilitating total or partial breakage of the said wall portion (31) when the said axial force is applied to it.

As illustrated particularly in FIGS. 4*a* to 4*d*, the said transfer means (5) may form a said second distinct part (51), typically a molded part forming a striker.

Figure 2A:
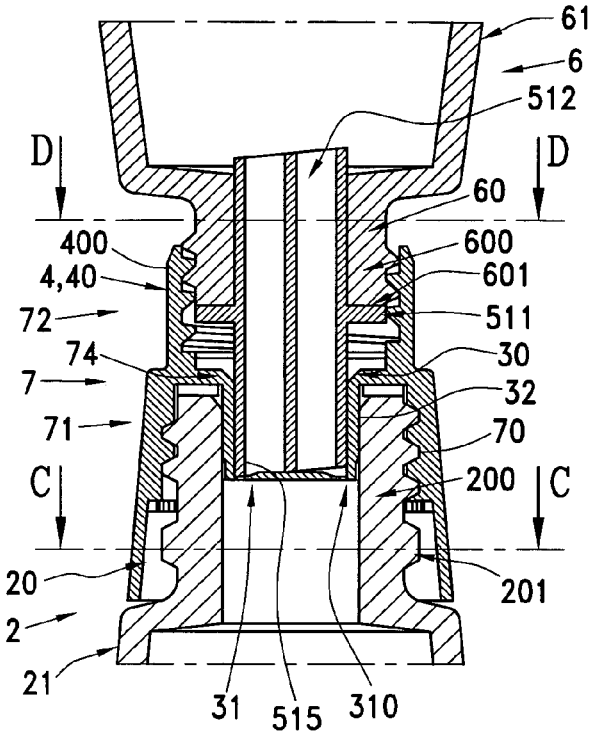
FIGS. 2*a* and 2*b* show partial axial sections illustrating the said main screwing and represent the said first part (7) and the striker (51) in position during the said first main screwing.

As illustrated in FIGS. 2*a*, 3*d*, 4*e*, the said wall (30) of the said closing means (3) may include a lower tubular part (32) closed off, typically at its lower end (320), by the said portion of wall (31) that can be broken, the said lower tubular part (32) being capable of providing axial guidance for the said transfer means or the said striker (51).

As illustrated in FIGS. 4*a* to 4*c*, the said striker (51) may comprise a central tube (510) that will cooperate with the said closing means, typically through its lower part (515), and typically with the said lower tubular part (32), and a radial ring (511) that can be placed facing the said locking ring (601) and axially in line with it such that the said axial force applied by the said locking ring (601) on the said radial ring (511) is transmitted to the said lower tubular part on which the said wall portion (31) is fitted.

The said central tube (510) may have an upper part (516) with height H and outside diameter D chosen so as to cooperate with the said first neck (60), the said upper part (516) penetrating into the said first neck (60). See FIGS. 4*a* and 4*b*.

The said central tube (510) may include an axial partition (512) forming an axial partition of the said central tube (510) creating two parallel channels or ducts (513, 514), one (513) typically intended for passage of the said typically liquid product, and the other (514) typically being intended for passage of air in the reverse direction.

The said central tube (510) may have a beveled lower end (515') and upper end (516'), such that firstly the said beveled lower end (515') facilitates breakage of the said wall portion (31), and secondly the said beveled upper end (516') facilitates parallel flow of the said liquid product and air in opposite directions.

Figures 6A, 6B, 6C:
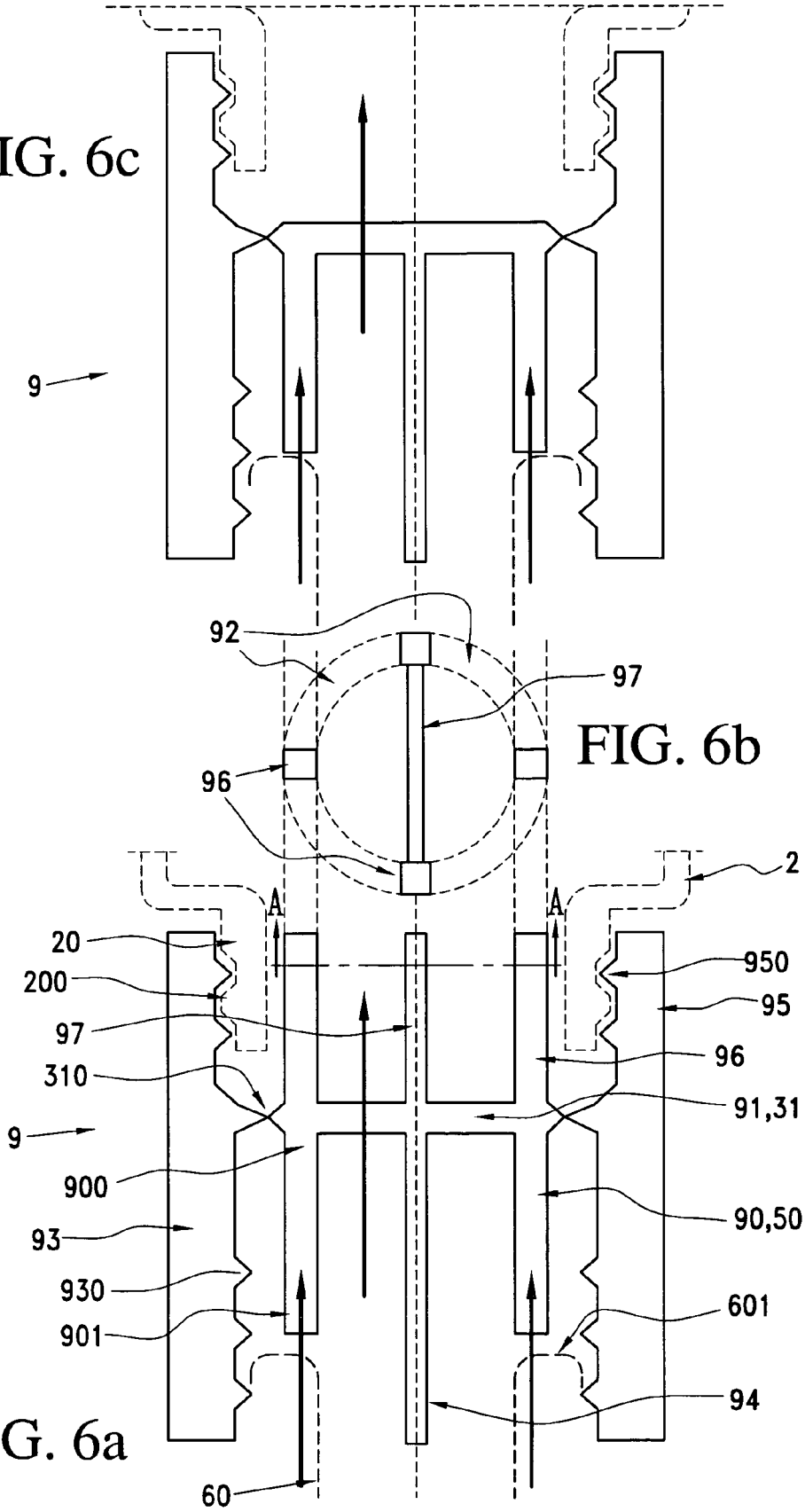

According to another embodiment of the invention illustrated in FIGS. 6*a* to 6*c*, the said transfer means (5) may form a typically molded single-piece head (9), with the said closing means (3).

The said transfer means (5) may comprise at least one axial projection (90) fixed at its upper end (900) to the said wall portion (31, 91), the said axial projection (90) being designed to be moved axially by the said first neck (60) during the said main screwing, its lower end (901) then being pushed by the said locking ring (601).

In this embodiment, the said transfer means (5) may include a plurality of N axial projections (90) at a uniform spacing where N varies from 2 to 8, with a space (92) between each so as to enable the said liquid product and air to pass when the said transfer means (5) and the said wall portion (31) are pushed into the said second neck (40) during the said first screwing. In the case shown in FIG. 6*b*, N is equal to 4.

The said single-piece head (9) may comprise a lower axial panel (94) forming a partition below the said wall portion (91, 31) so as to entirely or partly separate a parallel flow of the said liquid product and air in opposite directions.

Regardless of the embodiment of the invention, the said wall portion (31) may be typically plane and located in a horizontal plane or an inclined plane, the said lower part of the said axial packing (50) then forming an inclined plane or a horizontal plane respectively, so as to enable progressive breakage of the said wall portion (31) during the said first screwing.

According to the embodiment of the invention shown in FIGS. 1*a* to 2*b*, the said refill device may comprise three distinct parts; the said first part (7), the said second receptacle (2) and the said striker (51), the said first part (7), the said second receptacle (2) typically being assembled by screwing.

According to another embodiment of the invention illustrated in FIGS. 6*a* to 6*c*, the said refill device may comprise two distinct parts; the said single-piece head (9) including the said first part (7) and the said transfer means (5), and the said second receptacle (2), the said single-piece head (9) comprising a lower skirt (93) typically carrying an inner thread (930) capable of cooperating by the so-called main screwing with the said first neck (60), and an upper skirt (95) typically carrying an inner thread (950) capable of cooperating by so-called secondary screwing with the said secondary neck (20) of the said second receptacle (2), a seal (11) typically being used to assure leak tight closure of the said second receptacle by the said single-piece head.

In this embodiment, the said second receptacle may typically be made of a rigid material, typically glass or a moulded plastic material.

According to another embodiment of the invention, as illustrated in FIG. 4*e*, the said refill device (1) may include two parts; the said single-piece body (8) and the said second distinct part (51).

Finally, as illustrated in FIGS. 5*a* to 5*c*, the said refill device (1) may comprise a single-piece, the said single-piece body (8) and the said single-piece head (9) forming a single moulded part.

In both of these two cases, the said single-piece body (8) may be a receptacle open at the bottom, typically a flexible tube made of a thermoplastic material.

As illustrated in FIG. 4*f*, a cap (12) comprising a skirt provided with an outer thread may cooperate with the said base (40) before the said transfer, so as to protect the said transfer means (5) and the said wall portion (31).

As illustrated in FIGS. 7*a* and 7*b*, the said striker (5) may be a striker (51') comprising two inverted tapered pipes (517, 517'), offset in the axial direction and with a typically different average section. This type of striker (51') can facilitate the transfer of liquid from one receptacle to the other, and it can stop the transfer at a predetermined level as soon as the transferred liquid closes off the air outlet pipe.

EXAMPLES

Refill devices (1) were made according to all FIGS. 1*a* to 6*a*.

A) A Refill Device (1) was Made According to FIGS. 1*a* to 4*f* that Includes the Said First Part (7).

FIG. 1*a* shows a side view of the refill device (1) assembled by screwing the refill device needing to be placed above the said first receptacle (6) to the said first receptacle (6) to be refilled, before tipping, so that liquid can flow by gravity.

Figure 1B:
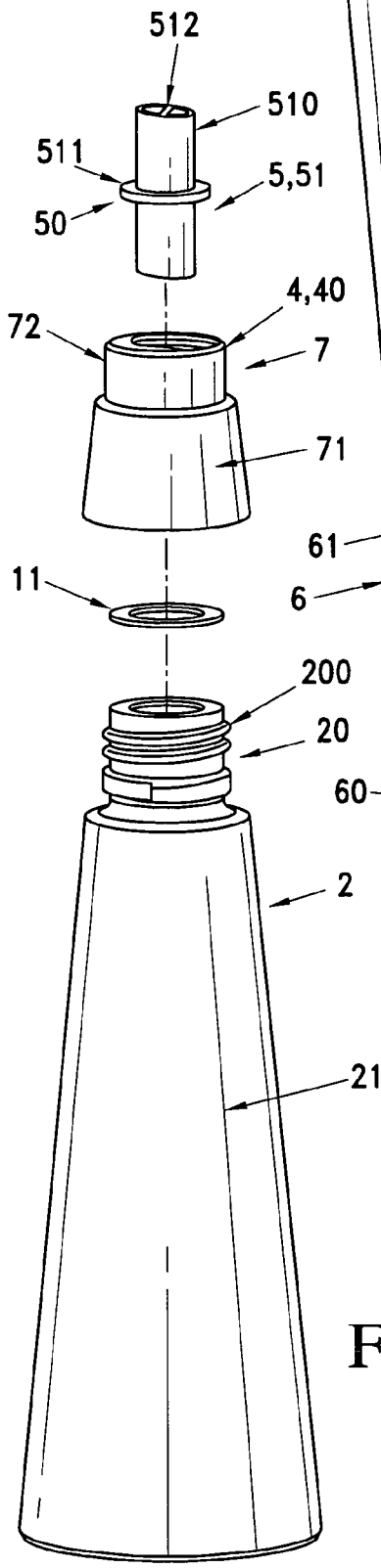
FIG. 1*b* is a perspective side view of the said refill device 1) in FIG. 1*a*, its various parts being presented separated one above the other.

FIG. 1*b* is a perspective side view of the said refill device, its different parts being shown at a spacing one above the other, as follows from bottom to top:

- the said second receptacle (2) comprising a body (21) and a neck (20) provided with a thread (200),
- a seal (11),
- a so-called first part (7) comprising particularly a lower skirt (71) with a thread on the inside, an upper skirt (72) with a thread on the inside forming the said base (40) of the said cooperation means (4),
- a striker (51) forming the said transfer means (5), composed of a central tube (510) and a radial ring (511) forming the said axial packing (51), the said central tube (510) comprising an axial partition (512) on the inside.

Figure 1C:
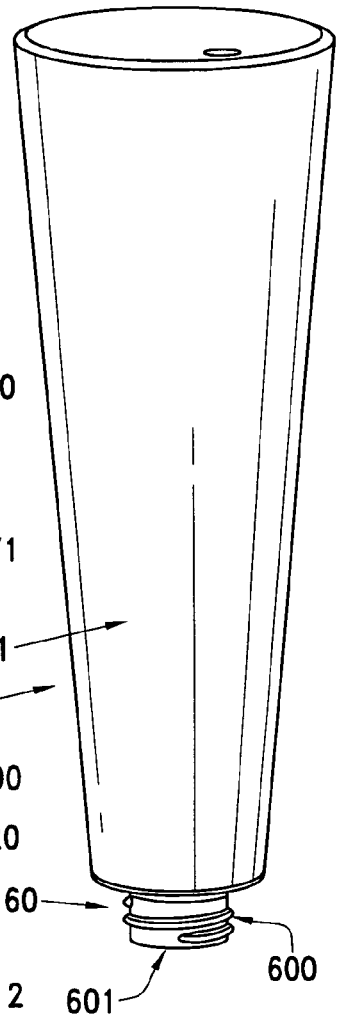
FIG. 1*c* is a perspective side view of the said first receptacle (6) in FIG. 1*a*.

FIG. 1*c* is a perspective side view of the said first receptacle (6) in FIG. 1*a*, the receptacle (6) comprising a body (61) and a neck (60) provided with a thread (600).

Figure 2C:
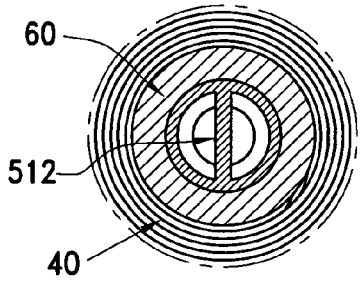
FIG. 2*c* shows a cross section D—D in FIG. 2*a*.
Figure 2D:
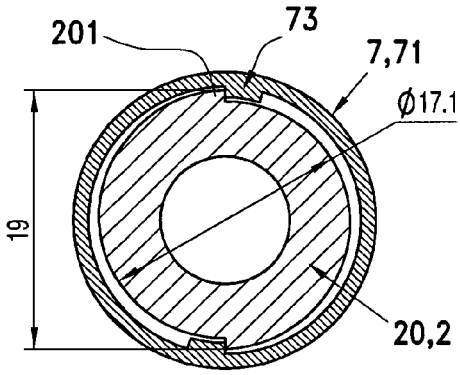
FIG. 2*d* shows a cross section C—C in FIG. 2*a*.
Figure 2E:
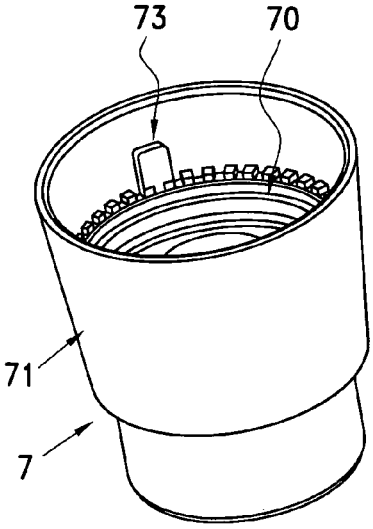
FIG. 2*e* shows a perspective bottom view of the said first part (7) in FIGS. 2*a* to 2*d*.
Figure 2B:
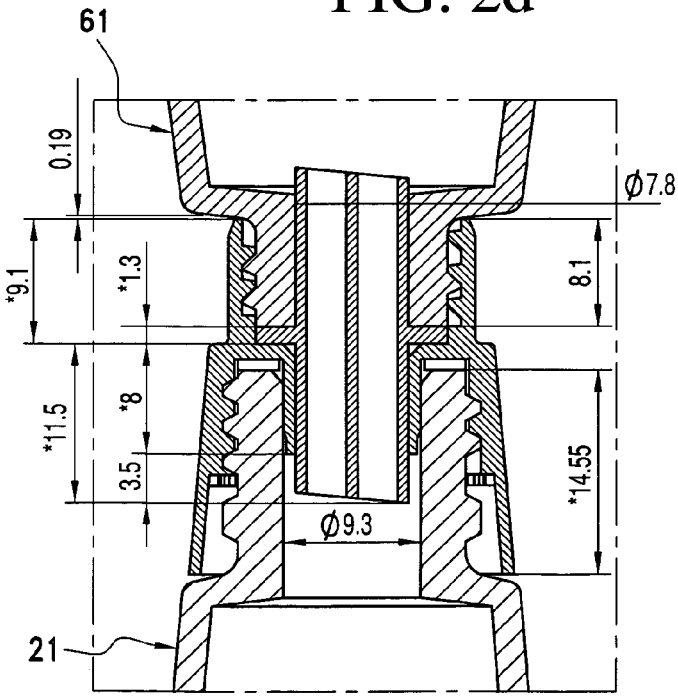

FIGS. 2*a* and 2*b* illustrate the said main screwing and represent the said first part (7) and the striker (51) in position during the said main screwing.

The said first part comprises three elements:

- an upper skirt (72) forming the said base (40) of the said cooperation means (4),
- a central part (74) forming the inner wall (30) of the said closing means (3), comprising a lower tubular part (32) carrying the said portion of the wall (31) to be broken at its lower end,
- a lower skirt (71) carrying the said secondary thread (70).

FIG. 2*a* corresponds to a first stage of the said main screwing, in which the said first neck (60) cooperates by screwing with the base (40), its locking ring (601) being in contact with the radial ring (511) of the striker (51) free to move in the axial direction, the said striker (51) having its lower end (515) in contact with the said portion of the wall (31) to be broken. This FIG. 2*a* corresponds to FIG. 1*a*, the said first receptacle (6) not yet being screwed fully into the said first part (7).

FIG. 2*b* corresponds to the last stage of the said main screwing; screwing of the said first receptacle (6) displaces the striker (51) and its lower end (515) tears the said wall portion (31) that comprises a thinned part (310) at its periphery such that since the bodies (21) and (61) communicate with each other, all that is necessary is to tip the second receptacle by 180° so that the liquid flows by gravity from the said second receptacle (2) to the said first receptacle (6).

FIG. 2*c* is a cross section D—D in FIG. 2*a*.

FIG. 2*d* is a cross section C—C in FIG. 2*a*.

FIG. 2*e* is a perspective bottom view of the said first part (7) in FIGS. 2*a* to 2*d*.

The said first part (7) was made according to FIGS. 3*a* to 3*d*.

The said striker (51) as a transfer means (5) was made in accordance with FIGS. 4*a* to 4*d*.

B) A Refill Device (1) was Made According to FIG. 4*e*.

In this embodiment of the invention, the said refill device (1) forms a single-piece part (8) comprising:

- an upper part (80) forming the said cooperation means (4) and the said base (40),
- a lower part (81) forming the said body (21) of the said second receptacle (2),
- an inner part (82) forming the said closing means (3) and the said wall (30).

C) Caps (12) were Made as Illustrated in FIG. 4*f*.

These caps (12) are screwed according to the said main screwing, so that during storage or transport of the said refill device (1), they prevent an unwanted axial force from being applied on the said striker (51) and fix the said striker (51) to the said refill device (1).

D) A Refill Device (1) was Made According to FIGS. 5*a* to 5*c*.

The device (1) forms a single-piece dispenser (9') shown in FIG. 5*a* before breakage of the said wall portion (31), and in FIG. 5*c* after breakage of the said wall portion. It comprises a lower skirt (93) fitted with an inner thread (930) to perform the said main screwing with the neck of the said first receptacle (60), the said first receptacle (6) being represented by a part of neck (60) shown in dashed lines. The said lower skirt (93) is fixed to the said body (21) of the said second receptacle (2), the said inner skirt (93) comprising a transverse wall portion (91, 31) on the inside carrying a plurality of axial projections (90) on the side of the said first receptacle (6), the plurality of axial projections acting as the said axial packings (50), and a lower axial panel (94).

E) A Refill Device (1) was Made According to FIGS. 6*a* to 6*c*.

In this device (1), the said closing means (3), the said cooperation means (4) and the said transfer means (5) form a single-piece head (9).

FIG. 6*a* shows the single-piece head (9) fitted with an upper skirt (95) provided with an inner thread (950) capable of cooperating with the thread (200) of the neck (20) of the said second receptacle (2) shown in dashed lines.

The said wall portion (91, 31) is provided with lower axial projections (90, 50) on one side, and a lower axial panel (94), as in the case shown in FIG. 5*a*, and on the opposite side, upper axial projections (96) and an upper axial panel (97).

FIG. 6*c* illustrates a variant embodiment of the device according to FIG. 6*a*. In this variant, unlike the case in FIG. 6*a*, the said wall portion (91, 31) is not provided with upper axial projections (96) and an upper axial panel (97).

F) Different Types of Strikers were Made, and Particularly Strikers of the Type Shown in FIGS. 7*a* and 7*b*.

In these variant strikers, the axial partitions (512), instead of delimiting two identical spaces or ducts, delimit two different sized spaces or ducts: the section of the duct or the perfume flow space is larger than the section of the air space.

Dispensers were also made with axial panels (94, 97) offset so as to have asymmetric spaces for the liquid and air flow.

Operation of the refill device:

At the time of filling, the receiving flask, namely the said first receptacle (6), is placed under the feeder flask, and the connection between the two flasks is leak tight. At the time of the transfer, the two containers (2) and (6) make a single cavity characterised by a throttle particularly at the closing means (3) and the portion of the wall (31) to be broken or pierced. It is important to at least partly separate the reverse flows of the two fluids present, so that liquid can be transferred in this closed chamber; the perfume goes down and the air rises, the perfume flows into the receiving flask automatically generating a negative pressure in the feeder flask. The at least partial separation of the two reverse flows prevents rising air from forming a "plug" thus preventing the perfume from going down.

Advantages of the Inventory

The invention has major advantages.

Firstly, it provides a simple, efficient and economic solution to the problems that arise.

Secondly, it offers many embodiments that can be adapted to all sorts of cases.

It is thus possible to have a refill device (1) made of only one single-piece part (9'), typically a partly or completely moulded part which is economically very advantageous.

In this case, there may be a feeder receptacle (2) in the form of a tube, made of a barrier material for long-term preservation of the product contained.

With some embodiments, a perfume contained in a rigid feeder flask forming the said second receptacle (2) can be transferred.

LIST OF ELEMENTS

Refill device . . . 1
Axial direction . . . 10
Seal of 9 . . . 11
Cap for 40 . . . 12
Second receptacle of 1 . . . 2
Second threaded neck of 2 . . . 20
  Thread of 20 . . . 200
  Anti-rotation notch . . . 201
Body of 2 . . . 21
Means of closing 1 . . . 3
Wall . . . 30
Wall portion to be broken . . . 31
  Thinned part . . . 310
Lower tubular part . . . 32
  Lower end of 32 . . . 320
Means of cooperation with 6 . . . 4
Base . . . 40
  Inner thread of 40 . . . 400
Means of transfer of 1 . . . 5
Axial packing . . . 50
Lower part of 50 . . . 500
Second part—striker . . . 51
  Central tube of 51 . . . 510
  Radial ring . . . 511
  Axial partition . . . 512
  Duct (liquid). . . 513
  Duct (air) . . . 514
  Lower part of 510 . . . 515
  Lower end of 515 . . . 515'
  Upper part of 510 . . . 516
  Upper end of 516 . . . 516'
  Tapered pipes . . . 517,517'
First receptacle . . . 6
First neck of 6 . . . 60
  Outer thread . . . 600
  Locking ring of 60 . . . 601
Body of 6 . . . 61
First part of 40+3 . . . 7
Secondary thread . . . 70
Lower skirt . . . 71
Upper skirt . . . 72
Anti-rotation notch . . . 73
Central part forming 3, 30 . . . 74
Single-piece part or body=2+3+4 8
Upper part forming 4, 40 . . . 80
Lower part forming 21 . . . 81
Inner part forming 3, 30 . . . 82
Single-piece head=3+4+5 9
Single-piece dispenser=2+3+4+5 9'
Lower axial projection . . . 90
  Upper end of 90 . . . 900
  Lower end of 90 . . . 901
Portion of wall 31 . . . 91
Space between two projections 90 . . . 92
Lower skirt . . . 93
  Inner thread of 93 . . . 930
Lower axial panel . . . 94
Upper skirt . . . 95
Upper axial projection . . . 96
Upper axial panel . . . 97

What is claimed is:

1. Refill device (1) for a first receptacle (6), a perfume flask, and provided with a first threaded neck (60) and an atomization head, comprising:

a) a receptacle, called the second receptacle (2), designed to contain a liquid product to be transferred into the said first receptacle (6), typically perfume, b) a means of cooperation (4) designed to form a sealed connection between the said first (6) and second (2) receptacles, c) a means (3) of closing off the said second receptacle (2), d) a means (5) of transferring the said product contained in the said second receptacle (2) to the said first receptacle (6), in which:

1) the said cooperation means (4) includes a threaded base (40), the said first neck (60) and the said base (40) being capable of cooperating by a so-called main screwing, the said first neck (60) comprising an external thread (600) and the said base (40) comprising an internal thread (400), so as to assure total or partial transfer of the said product contained in the said second receptacle, into the said first receptacle, 2) the said closing means (3) comprises a wall (30) closing off the said base (40), at least one portion (31) of the said wall (30) being designed to be broken off by an axial force, 3) the said transfer means (5) comprises an axial packing (50) placed or designed to be placed above the said portion (31) of the wall, such that during the said main screwing, the said first neck (60) and a locking ring (601), moves or pushes the said axial packing (50) into contact with the said wall portion (31), such that the said axial packing (50), applying the said axial force on the said portion (31) of the wall through its lower part (500), breaks or perforates the said wall portion (31), and such that the said first (6) and second (2) receptacles are put into communication and cooperating through the said main screwing, enabling the said transfer, typically by gravity, of the fluid product contained in the said second receptacle (2) to the said first receptacle (6), the said second receptacle (2) being placed above the said first receptacle (6), 4) the said wall portion (31) includes a peripheral area (310) that is completely or partly thinned, so as to form an area of weakness facilitating total or partial breakage of the said wall portion (31) when the said axial force is applied to it.

2. Device according to claim 1, in which the said closing means (3) forms a first part (7) with the said base (40), a moulded part separate from the said second receptacle (2), capable of being fixed to the said second receptacle, typically by a so-called secondary screwing using a so-called secondary thread (70), the said first part (7) comprising a lower skirt (71) carrying the said secondary thread (70) on its inside surface that can cooperate by screwing with a threaded neck (20) of the said second receptacle (2), a seal (11) being used to make a leak tight closure of the said second receptacle (2) by the said first part (7), the said lower skirt (71) comprising at least one anti-rotation notch (73) to block the said secondary screwing.

3. Device according to claim 1, in which the said second receptacle (2) and the said base (40) provided with the said closing means (3) form a typically molded single-piece part or body (8).

4. Device according to claim 1, in which the said transfer means (5) forms a said second distinct part (51), a molded part forming a striker.

5. Device according to claim 1, in which the said wall (30) of the said closing means (3) includes a lower tubular part (32) closed off, at its lower end (320), by the said portion of wall (31) that can be broken, the said lower tubular part (32) being capable of providing axial guidance for the said transfer means or the said striker (51).

6. Device according to claim 1, in which the said striker (51) comprises a central tube (510) that will cooperate with the said closing means, through its lower part (515), and with the said lower tubular part (32), and a radial ring (511) that can be placed facing the said locking ring (601) and axially in line with it such that the said axial force applied by the said locking ring (601) on the said radial ring (511) is transmitted to the said lower tubular part on which the said wall portion (31) is fitted.

7. Device according to claim 6, in which the said central tube (510) has an upper part (516) with height H and outside diameter D chosen so as to cooperate with the said first neck (60), the said upper part (516) penetrating into the said first neck (60).

8. Device according to claim 6, in which the said central tube (510) includes an axial partition (512) forming an axial partition of the said central tube (510) creating two parallel channels or ducts (513, 514), one (513) intended for passage of the said liquid product, and the other (514) intended for passage of air in the reverse direction.

9. Device according to claim 6, in which the said central tube (510) has a bevelled lower end (515') and upper end (516'), such that firstly the said bevelled lower end (515') facilitates breakage of the said wall portion (31), and secondly the said bevelled upper end (516') facilitates parallel flow of the said liquid product and air in opposite directions.

10. Device according to claim 1, in which the said transfer means (5) forms a molded single-piece head (9), with the said closing means (3).

11. Device according to claim 10, in which the said transfer means (5) comprises at least one axial projection (90) fixed at its upper end (900) to the said wall portion (31, 91), the said axial projection (90) being designed to be moved axially by the said first neck (60) during the said main screwing, its lower end (901) then being pushed by the said locking ring (601).

12. Device according to claim 10, in which the said transfer means (5) includes a plurality of N axial projections (90) at a uniform spacing where N varies from 2 to 8, with a space (92) between each so as to enable the said liquid product and air to pass when the said transfer means (5) and the said wall portion (31) are pushed into the said second neck (40) during the said first screwing.

13. Device according to claim 10, in which the said single-piece head (9) comprises a lower axial panel (94) forming a partition below the said wall portion (91, 31) so as to entirely or partly separate a parallel flow of the said liquid product and air in opposite directions.

14. Device according to claim 1, in which the said wall portion (31) is plane and located in a horizontal plane or an inclined plane, the said lower part of the said axial packing (50) then forming an inclined plane or a horizontal plane respectively, so as to enable progressive breakage of the said wall portion (31) during the said first screwing.

15. Device according to claim 2, comprising three distinct parts; the said first part (7), the said second receptacle (2) and the said striker (51), the said first part (7), the said second receptacle (2) typically being assembled by screwing.

16. Device according to claim 2, comprising two distinct parts; the said single-piece head (9) including the said first part (7) and the said transfer means (5), and the said second receptacle (2), the said single-piece head (9) comprising a lower skirt (93) typically carrying an inner thread (930) capable of cooperating by the so-called main screwing with the said first neck (60), and an upper skirt (95) carrying an inner thread (950) capable of cooperating by so-called secondary screwing with the said secondary neck (20) of the said second receptacle (2), a seal (11) being used to assure leak tight closure of the said second receptacle by the said single-piece head.

17. Device according to claim 15, in which the said second receptacle is made of a rigid material, glass or a moulded plastic material.

18. Device according to claim 3, including two parts; the said single-piece body (8) and the said second distinct part (51).

19. Device according to claim 3, comprising a single-piece, the said single-piece body (8) and the said single-piece head (9) forming a single molded part.

20. Device according to claim 18, in which the said single-piece body (8) may be a receptacle open at the bottom, a flexible tube made of a thermoplastic material.

21. Device according to claim 1, in which a cap (12) comprising a skirt provided with an outer thread cooperates with the said base (40) before the said transfer, so as to protect the said transfer means (5) and the said wall portion (31).

22. Device according to claim 4, in which the said striker (5) is a striker (5') comprising two inverted tapered pipes (517, 517'), offset in the axial direction and with a different average section.

* * * * *